US005652993A

United States Patent [19]

Kreyer

[11] Patent Number: 5,652,993

[45] Date of Patent: Aug. 5, 1997

[54] KNIFE CLEANER

[76] Inventor: James W. Kreyer, 391 Highway 64 East, Conway, Ark. 72032

[21] Appl. No.: 431,508

[22] Filed: Apr. 28, 1995

[51] Int. Cl.[6] ..... A63B 57/00; A46B 11/00

[52] U.S. Cl. ..... 015/104.92; 015/160

[58] Field of Search ..... 015/104.92, 160, 015/220.4, 221, 21.2, 210.1, 88.1, 21.1, 218, 218.1

[56] References Cited

U.S. PATENT DOCUMENTS

| | | | |
|---|---|---|---|
| 597,729 | 1/1898 | Mitchell | 15/104.92 |
| 1,488,930 | 4/1924 | Mannix | 15/264 |
| 2,478,522 | 8/1949 | Buskirk | 15/104.92 |
| 4,872,235 | 10/1989 | Nielsen | 15/104.92 |
| 5,222,271 | 6/1993 | Eganhouse | 15/104.92 |
| 5,404,610 | 4/1995 | Coyer, Sr. et al. | 15/104.92 |

FOREIGN PATENT DOCUMENTS

| | | | |
|---|---|---|---|
| 57351 | 8/1946 | Netherlands | 15/104.92 |
| 237292 | 10/1960 | Netherlands | 15/104.92 |
| 1193781 | 6/1970 | United Kingdom | 15/104.92 |

*Primary Examiner*—Gary K. Graham

[57] ABSTRACT

A cleaner for removing ink from a knife. The inventive device includes a plate having a central aperture which can be suspended within a container of solvent. A pair of facing brushes are mounted to the plate on opposed sides of the central aperture and operate to clean opposed faces of a knife positioned through the plate aperture to remove ink and debris from the knife.

11 Claims, 3 Drawing Sheets

KNIFE CLEANER

BACKGROUND OF THE INVENTION

1. Related Data

The subject matter of the present utility patent application has been registered under the discloser document program at the United States Patent and Trademark Office. The request was received at the Patent Office on Dec. 13, 1994 and was assigned the registration number 366,626.

2. Field of the Invention

The present invention relates to cleaning implements and more particularly pertains to an knife cleaner for removing ink from a knife.

DESCRIPTION OF THE PRIOR ART

The use of cleaning implements is known in the prior art. More specifically, cleaning implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning implements include U.S. Pat. No. 4,547,923; U.S. Pat. No. 4,245,367; U.S. Pat. No. 4,087,878; U.S. Pat. No. 5,191,670; and U.S. Pat. No. 4,374,445.

While these devices fulfill their respective, particular objectives and requirements, the aforementioned patents do not disclose a knife cleaner for removing ink from a knife which includes a plate having a central aperture which can be suspended within a container of solvent and a pair of facing brushes mounted to the plate on opposed sides of the central aperture which operate to clean opposed faces of a knife positioned through the plate aperture to remove ink and debris from the knife.

In these respects, the knife cleaner according to the present invention substantially departs from the conventional concepts and designs of the prior art, and in so doing provides an apparatus primarily developed for the purpose of removing ink from a knife.

SUMMARY OF THE INVENTION

In view of the foregoing disadvantages inherent in the known types of cleaning implements now present in the prior art, the present invention provides a new knife cleaner construction wherein the same can be utilized for cleaning opposed faces of a knife. As such, the general purpose of the present invention, which will be described subsequently in greater detail, is to provide a new knife cleaner apparatus and method which has many of the advantages of the cleaning implements mentioned heretofore and many novel features that result in a knife cleaner which is not anticipated, rendered obvious, suggested, or even implied by any of the prior art cleaning implements, either alone or in any combination thereof.

To attain this, the present invention generally comprises a cleaner for removing ink from a knife. The inventive device includes a plate having a central aperture which can be suspended within a container of solvent. A pair of facing brushes are mounted to the plate on opposed sides of the central aperture and operate to clean opposed faces of a knife positioned through the plate aperture to remove ink and debris from the knife.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knife cleaner apparatus and method which has many of the advantages of the cleaning implements mentioned heretofore and many novel features that result in a knife cleaner which is not anticipated, rendered obvious, suggested, or even implied by any of the prior art cleaning implements, either alone or in any combination thereof.

It is another object of the present invention to provide a new knife cleaner which may be easily and efficiently manufactured and marketed.

It is a further object of the present invention to provide a new knife cleaner which is of a durable and reliable construction.

An even further object of the present invention is to provide a new knife cleaner which is susceptible of a low cost of manufacture with regard to both materials and labor, and which accordingly is then susceptible of low prices of sale to the consuming public, thereby making such knife cleaners economically available to the buying public.

Still yet another object of the present invention is to provide a new knife cleaner which provides in the apparatuses and methods of the prior art some of the advantages thereof, while simultaneously overcoming some of the disadvantages normally associated therewith.

Still another object of the present invention is to provide a new knife cleaner for cleaning opposed faces of a knife to remove ink therefrom.

Yet another object of the present invention is to provide a new knife cleaner which includes a plate having a central aperture which can be suspended within a container of solvent, and a pair of facing brushes mounted to the plate on opposed sides of the central aperture which operate to clean opposed faces of a knife positioned through the plate aperture to remove and debris from the knife.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
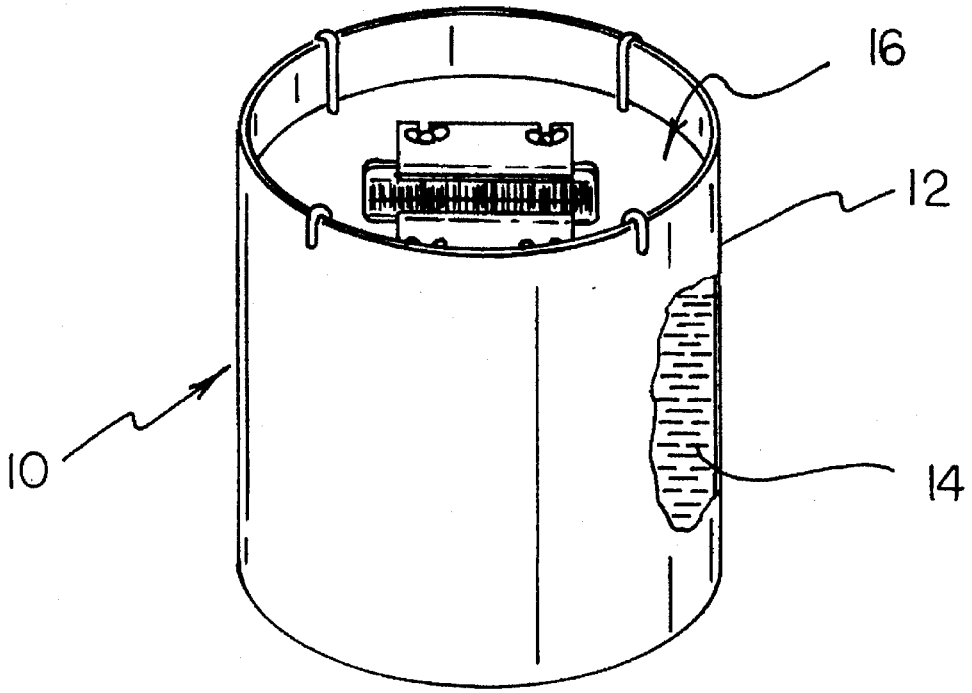
FIG. 1 is an isometric illustration of a knife cleaner according to the present invention.
Figure 2:
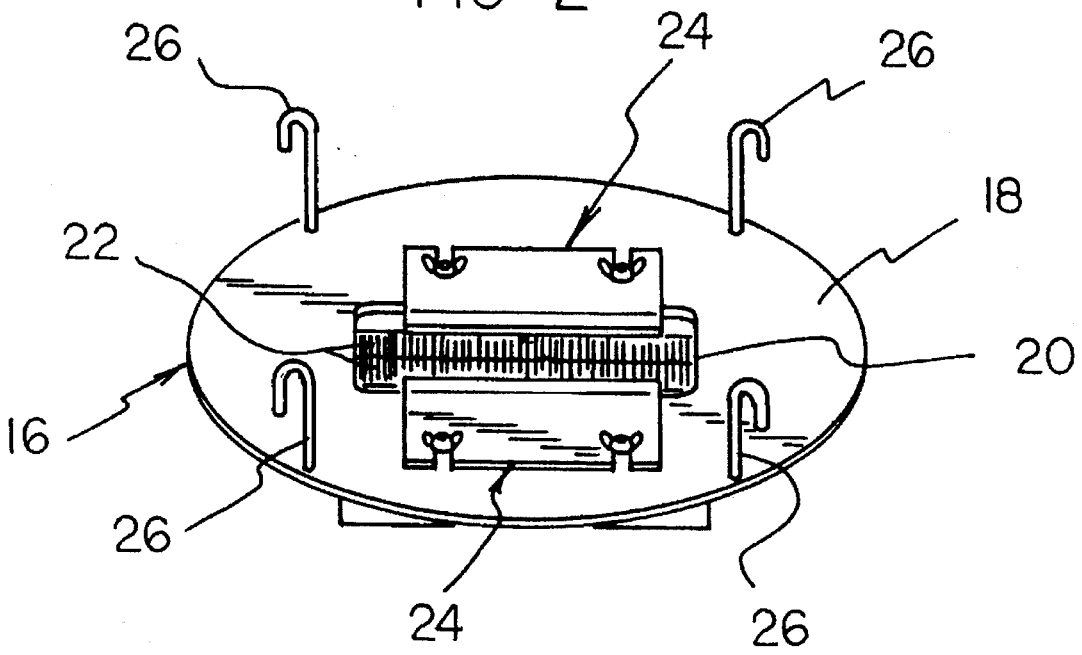
FIG. 2 is an isometric illustration of a brush means comprising a portion of the present invention.
Figure 3:
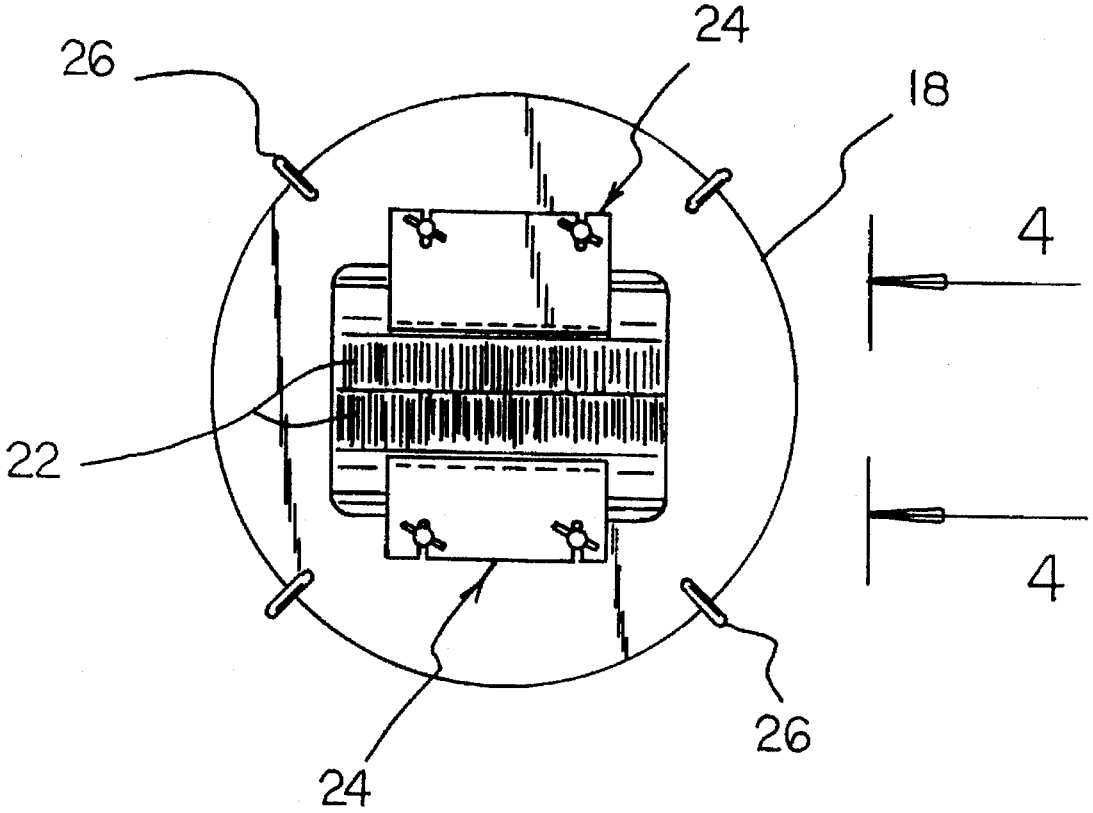
FIG. 3 is a top plan view of the brush means.

With reference now to the drawings, and in particular to FIGS. 1–5 thereof, a new knife cleaner embodying the principles and concepts of the present invention and generally designated by the reference numeral 10 will be described.

More specifically, it will be noted that the knife cleaner 10 comprises a container 12 having a fluid solvent 14 positioned therewithin. A brush means 16 is suspended within the container 12 and preferably submerged within the solvent or fluid 14 for effecting mechanical cleaning of opposed faces of a knife positioned into the container 12. By this structure, a knife or other elongated planar object having ink of other debris present thereon can be engaged to the brush means 16 and the solvent of fluid 14 within the container 12 to effect cleaning of the knife, as shown in FIG. 1 of the drawings.

Referring now to FIGS. 2 through 5, it can be shown that the brush means 16 of the present invention 10 preferably comprises a substantially circular plate 18 having a center aperture 20 directed therethrough. The center aperture 20 is preferably substantially rectangular in shape and includes opposed longitudinal edges orthogonally intersected by spaced and parallel transverse edges. A pair of facing brushes 22 are mounted to the circular plate 18 on opposed sides of the center aperture 20. To this end, the present invention 10 includes a pair of clamp means 24 for securing the facing brushes 22 to the opposed longitudinal edges of the center aperture 20. A plurality of support hooks 26 project from the circular plate 18 and are operable to engage an upper open end of the container 12 so as to suspend the circular plate 18 of the brush means 16 within the fluid 14 as shown in FIG. 1 of the drawings.

Figure 4:
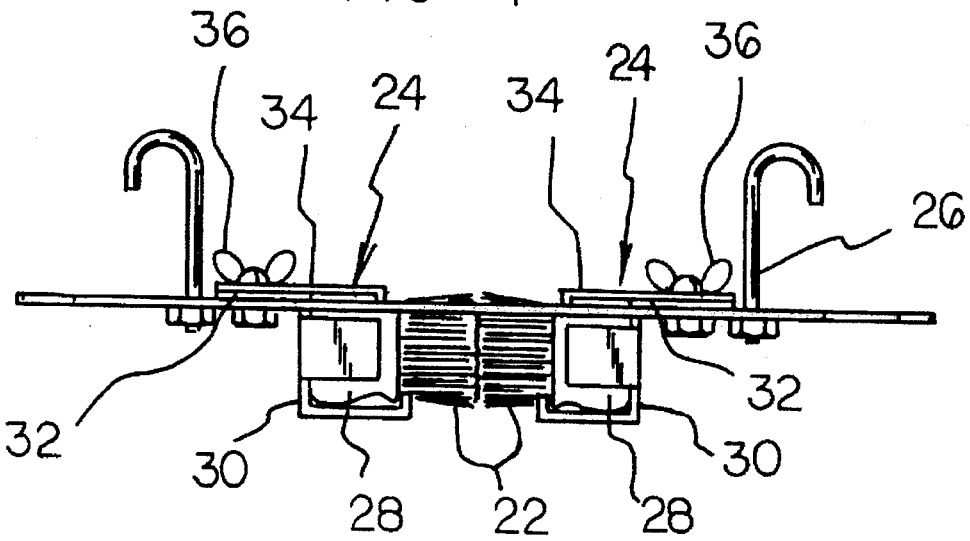
FIG. 4 is a side elevation view thereof taken from line 4—4 of FIG. 3.
Figure 5:
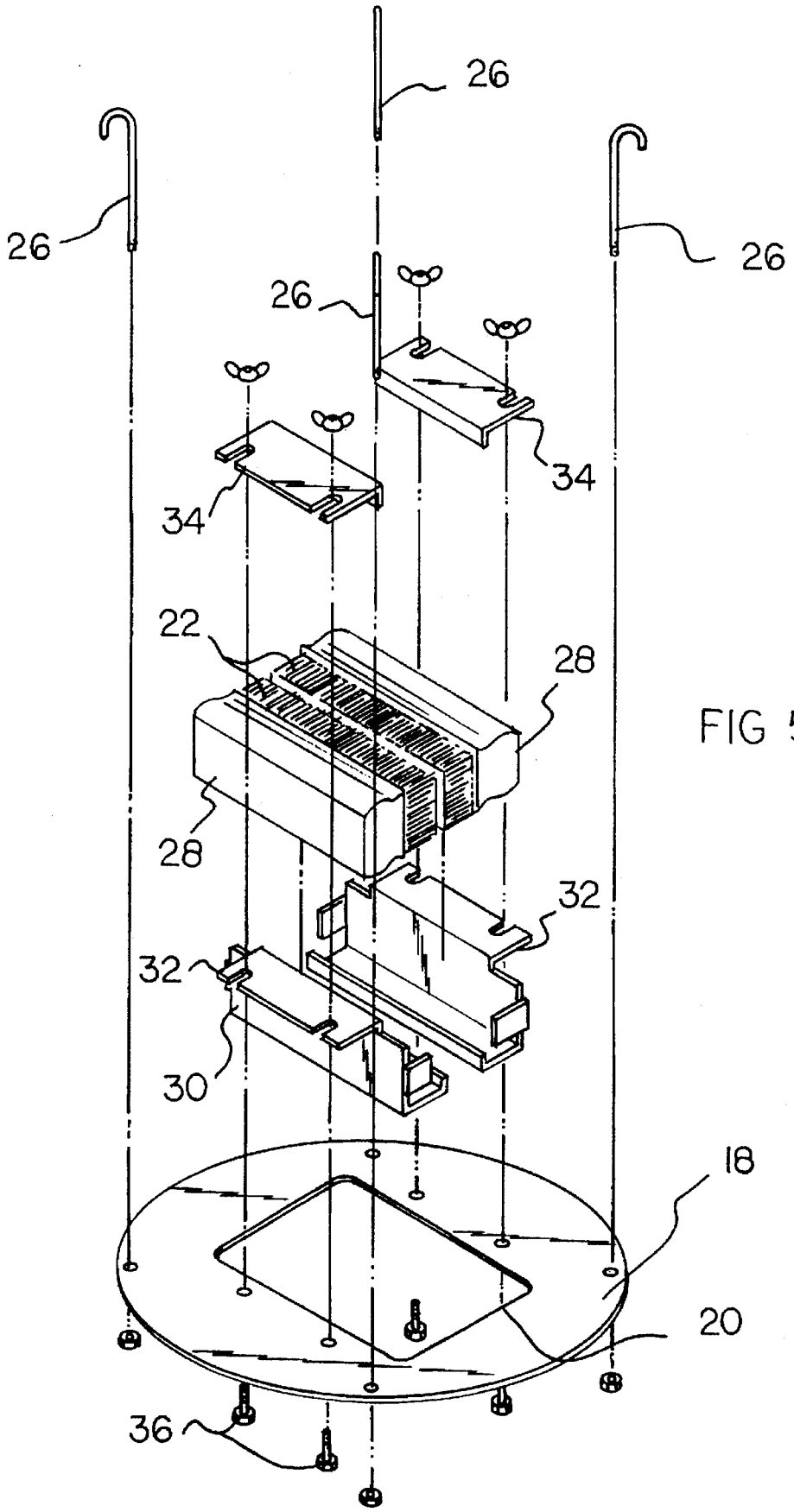
FIG. 5 is an exploded isometric illustration of the brush means of the present invention.

Referring now to FIGS. 4 and 5, it can be shown that each of the facing brushes 22 includes an elongated brush handle 28 having a plurality of brush fibers projecting substantially orthogonally therefrom. Each of the brush handles 28 is engaged by one of the clamp means 24 so as to couple the brush 22 beneath the circular plate 18 of the brush means 16. To this end, the clamp means 24 each comprise a handle receiver 30 within which the brush handle 28 can be positioned. A mounting flange 32 projects from the handle receiver 30 and is positioned into an abutting orientation relative to the circular plate 18. A clamp plate 34 is positioned on top of the mounting flange 32 and extends into contact with the brush handle 28 so as to secure the brush handle within the handle receiver 30. A plurality of releasable fasteners 36 are directed through the circular plate 18, the mounting flange 32, and the clamp plate 34 and cooperate to secure the clamp means 24 and the associated brushes 22 relative to the circular plate 18. By this structure, an individual can selectively remove the brushes 22 as desired by simply removing the fasteners 36, whereby separation of the clamp plate 34 from the handle receiver 30 is permitted such that the brush handle 28 can then be removed from the handle receiver.

In use, the knife cleaner 10 according to the present invention can be easily utilized to effect cleaning of opposed surfaces of a knife or other elongated object positioned between the facing brushes 22. The brush means 16 of the present invention 10 is preferably submerged within the fluid 14 in the container 12 such that the brushes 22 do not cause splattering or splashing of the fluid or solvent during use of the device 10. The present invention 10 substantially eliminates a need for a prior art method of washing ink knifes by simply saturating a towel with a solvent and wiping the ink off, thereby reducing waste and maintaining the solvent or fluid 14 within a predetermined location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A knife cleaner comprising:

a container having a fluid solvent positioned therewithin; and a brush means suspended within the container for effecting mechanical cleaning of opposed faces of a knife positioned into the container;

wherein the brush means includes at least three support hooks projecting from said brush means and being engaged to an upper open end of the container so as to suspend the brush means within said container in a manner permitting said brush means to be easily lifted in a substantially straight upward direction out of said container.

2. The knife cleaner of claim 1, wherein the brush means is submerged within the solvent of the container.

3. The knife cleaner of claim 2, wherein the brush means comprises a circular plate having a center aperture directed therethrough, the center aperture including opposed longitudinal edges; and a pair of facing brushes mounted to the circular plate on opposed sides of the center aperture.

4. The knife cleaner of claim 3, wherein the brush means further comprises a pair of clamp means for securing the facing brushes to the opposed longitudinal edges of the center aperture of the plate.

5. A knife cleaner comprising, a container having a fluid solvent positioned therewithin;

a brush means suspended within the container for effecting mechanical cleaning of opposed faces of a knife positioned into the container;

wherein the brush means is submerged within the solvent of the container;

wherein the brush means comprises a circular plate having a center aperture directed therethrough, the center aperture including opposed longitudinal edges; and a pair of facing brushes mounted to the circular plate on opposed sides of the center aperture;

wherein the brush means further comprises a pair of clamp means for securing the facing brushes to the opposed longitudinal edges of the center aperture of the plate;

wherein the brush means further comprises a plurality of support hooks projecting from the plate and being engaged to an upper open end of the container so as to suspend the plate of the brush means therewithin.

6. The knife cleaner of claim 5, wherein the facing brushes each include an elongated brush handle having a plurality of brush fibers projecting substantially orthogonally therefrom, each of the brush handles being engaged by an individual one of the clamp means so as to couple the brush beneath the plate of the brush means.

7. The knife cleaner of claim 6, wherein the clamp means each comprise a handle receiver within which the brush handle is positioned; a mounting flange projecting from the handle receiver and being positioned into an abutting orientation relative to the plate; a clamp plate positioned on top of the mounting flange and extending into contact with the brush handle so as to secure the brush handle within the handle receiver; and a plurality of releasable fasteners directed through the plate, the mounting flange, and the clamp plate to secure the clamp means and the brushes relative to the plate.

8. A knife cleaner comprising:

a brush means for suspending within a container for effecting mechanical cleaning of opposed faces of a knife positioned into the container, the brush means comprising a circular plate having a center aperture directed therethrough, the center aperture including opposed longitudinal edges; a pair of facing brushes mounted to the circular plate on opposed sides of the center aperture; and a plurality of support hooks projecting from the plate and being engagable to an upper open end of a container so as to suspend the plate of the brush means therewithin.

9. The knife cleaner of claim 8, wherein the brush means further comprises a pair of clamp means for securing the facing brushes to the opposed longitudinal edges of the center aperture of the plate.

10. The knife cleaner of claim 9, wherein the facing brushes each include an elongated brush handle having a plurality of brush fibers projecting substantially orthogonally therefrom, each of the brush handles being engaged by an individual one of the clamp means so as to couple the brush beneath the plate of the brush means.

11. The knife cleaner of claim 10, wherein the clamp means each comprise a handle receiver within which the brush handle is positioned; a mounting flange projecting from the handle receiver and being positioned into an abutting orientation relative to the plate; a clamp plate positioned on top of the mounting flange and extending into contact with the brush handle so as to secure the brush handle within the handle receiver; and a plurality of releasable fasteners directed through the plate, the mounting flange, and the clamp plate to secure the clamp means and the brushes relative to the plate.

* * * * *